US007819097B2

(12) United States Patent
Shui

(10) Patent No.: US 7,819,097 B2
(45) **Date of Patent: *Oct. 26, 2010**

(54) POPPET CYLINDER VALVE OPERATING SYSTEM FOR INTERNAL COMBUSTION ENGINE

(75) Inventor: Fang Shui, Farmington Hills, MI (US)

(73) Assignee: Ford Global Technologies, Dearborn, MI (US)

( * ) Notice: Subject to any disclaimer, the term of this patent is extended or adjusted under 35 U.S.C. 154(b) by 765 days.

This patent is subject to a terminal disclaimer.

(21) Appl. No.: 11/163,956

(22) Filed: Nov. 4, 2005

(65) Prior Publication Data

US 2007/0101957 A1 May 10, 2007

(51) Int. Cl.
*F01L 1/34* (2006.01)

(52) U.S. Cl. ..... 123/90.16; 123/90.15; 123/345

(58) Field of Classification Search ..... 123/90.15, 123/90.16, 90.17, 90.18, 90.27, 90.31, 90.39, 123/90.44

See application file for complete search history.

(56) References Cited

U.S. PATENT DOCUMENTS 4,503,818 A 3/1985 Hara et al.
4,539,951 A 9/1985 Hara et al.
5,680,837 A * 10/1997 Pierik ..... 123/90.17
5,682,854 A 11/1997 Ozawa
6,129,061 A * 10/2000 Okuda et al. ..... 123/90.17
6,425,357 B2 * 7/2002 Shimizu et al. ..... 123/90.16
6,457,446 B1 * 10/2002 Willmot ..... 123/90.17
6,722,326 B1 4/2004 Shui et al.
6,823,826 B1 11/2004 Sugiura et al.
6,907,852 B2 6/2005 Schleusener et al.
6,932,035 B1 8/2005 Shui et al.
2004/0069259 A1 4/2004 Shui et al.

FOREIGN PATENT DOCUMENTS

DE 23 37 885 2/1975

* cited by examiner

*Primary Examiner*—Ching Chang
(74) *Attorney, Agent, or Firm*—Jerome R. Drouillard; Julia Voutyras

(57) ABSTRACT

A poppet valve operating system for an internal combustion engine features variable valve lift and camshaft phasing. A planetary phaser uses control inputs which are shared with a variable lift mechanism. The phaser adjustment and the variable lift mechanism are controlled by a single positioning motor.

10 Claims, 2 Drawing Sheets

POPPET CYLINDER VALVE OPERATING SYSTEM FOR INTERNAL COMBUSTION ENGINE

TECHNICAL FIELD

The present invention relates to a system for operating poppet-type cylinder valves of reciprocating internal combustion engine, so as to selectively control the duration and phasing of the valve opening events.

BACKGROUND

Variable valve duration control devices have been the subject of much invention during the past few decades. U.S. Pat. No. 5,373,818 discloses but one example of such inventive activity. The '818 patent describes a variable duration valve operating system having at least one embodiment which is useful with bucket tappets. U.S. Pat. No. 6,932,035, which is assigned to the assignee of the present invention, and which is hereby incorporated by reference in its entirety in this specification, discloses a cylinder valve operating system which permits adjustment of valve lift, particularly with roller finger follower systems. The system of the '035 patent does not, however, provide for camshaft phasing.

The present system may be used with such systems as axially shiftable camshafts and other valve lift control devices to control both valve lift and valve or camshaft timing.

SUMMARY

A poppet valve operating system for an internal combustion engine includes a poppet valve, a camshaft, a variable valve lift control system driven by the camshaft. The variable valve lift control system has an angular control input. The present system further includes a camshaft phaser driving the camshaft and having an angular control input, and a controller for providing angular position control for the variable valve lift control system and for the camshaft phaser.

According to another aspect of the present invention, the system's controller includes a single motor operatively connected with an angular control shaft incorporated within the variable valve lift control system, with said controller further including a servo system extending between the valve lift control system and the angular control input of the camshaft phaser. Either a hydraulic motor, or an electric motor, such as a stepper motor, could be used with the present valve control system. In a preferred embodiment, the servo system may include a flexible position transmitting system.

One type of servo system suitable for practicing the present invention includes a drive sprocket mounted to the angular control shaft of the variable valve lift control system, a driven sprocket mounted to that portion of the camshaft phaser which functions as an angular control input, and a chain extending between the drive and driven sprockets. As an alternative, the servo system may include a gear train having at least a drive gear attached to the angular control shaft and a driven gear attached to the angular control input of the camshaft phaser.

According to yet another aspect of the present invention, a phaser suitable for use with this invention includes a planetary drive having a sun gear driven by the engine's crankshaft, and a number of planet gears driven by the sun gear. The planet gears are mounted rotatably upon a carrier having an angular position which is determinative of the camshaft's timing. A ring gear driven by the planet gears is rotatably locked to the camshaft. With this configuration, the carrier is coupled to the valve lift control system by the servo mechanism.

According to yet another aspect of the present invention, a method for controlling the valve lift and timing of a poppet valve for an internal combustion engine includes the steps of: providing a variable valve lift control system driven by a camshaft and having an angular input control shaft; providing a planetary camshaft phaser for driving said camshaft and having an angular input control carrier; and providing a single-motor controller for controlling the angular positions of said angular input control shaft and said angular input control carrier.

The present valve operating system offers the advantages attendant the ability to control of both valve lift and timing, but with lower cost, less complexity, and less package volume than known systems, because of the need for only a single actuator motor.

Other advantages, as well as objects and features of the present invention, will become apparent to the reader of this specification.

DETAILED DESCRIPTION OF THE PREFERRED EMBODIMENTS

Figure 1:
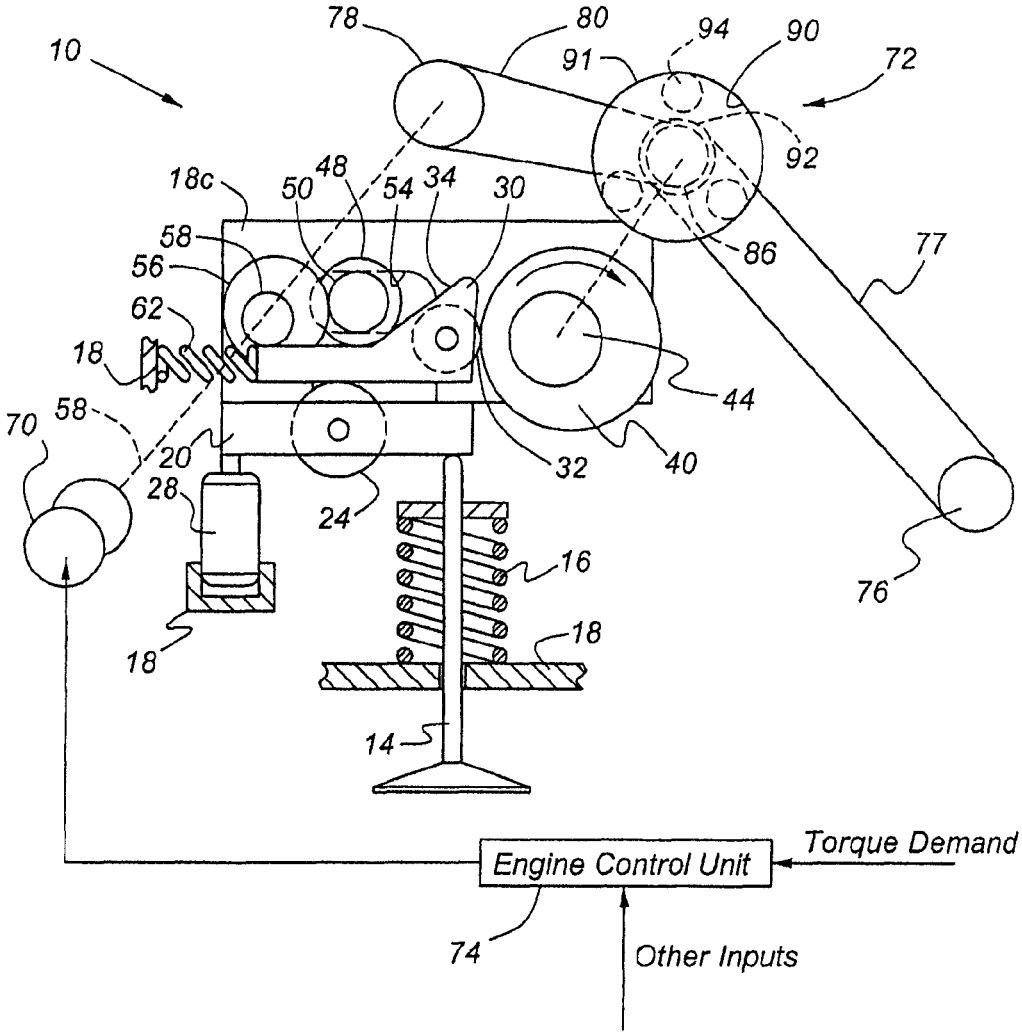
FIG. 1 is a schematic representation of a poppet valve operating system according to the present invention.

As shown in FIG. 1, the present cylinder valve operating system, 10, is intended for use with poppet valves 14, which are mounted within cylinder head 18 of an engine. Valves 14 are returned to their closed positions by means of valve springs 16. Each of valves 14 is actuated by means of a finger follower, 20, which has a first end in contact with valve 14 and a second end in contact with lash adjuster 28, which is mounted to cylinder head 18. Finger follower 20 has a roller, 24, which contacts intermediate rocker 30.

Intermediate rocker 30 is biased into contact with drive cam 40 by means of compression spring 62. Alternatively, a torsion spring (not shown) could be used for this purpose. Intermediate rocker 30 rotatably actuates finger follower 20 as drive cam 40, which is mounted upon camshaft 44, and driven either by a crankshaft or other rotating member of the engine (not shown), pushes upon rocker roller 32, thereby moving intermediate rocker 30 translationally. Camshaft 44 and intermediate rocker 30 are mounted so that the motion imparted by camshaft 44 and drive cam 40 to intermediate rocker 30 is purely translational. This translational movement is controllably transformed into rotational movement of intermediate rocker 30 by control roller 48, which is mounted upon support shaft 50. In essence, intermediate rocker 30 pivots about an instantaneous contact point existing between control surface 34 and the outer diametral surface of control shaft 58. Support shaft 50 is carried within control slot 54 formed in cylinder head 18*c*. Alternatively, support shaft 50 may be carried within a slotted member rigidly attached to cylinder head 18.

Control slot 54 permits translational movement of support shaft 50. This translational movement is produced by control cam 56 which is mounted upon control shaft 58. As control shaft 58 is rotated by control motor 70, control cam 56 displaces control shaft 58 within slot 54, so as to move control roller 48 to a new operating position. In general, when control roller 48 is moved closer to camshaft 44, valve lift will be increased because control roller 48 will be operating on rocker ramp 34, which is a control surface formed in intermediate rocker 30.

Engine control unit 74, which may be selected from commonly employed engine controllers known to those skilled in the art and suggested by this disclosure, operates control motor 70, which, as described above, is coupled to control shaft 58. Control unit 74 receives inputs from the vehicle's driver, in the form of a torque demand, as well as inputs from a variety of sensors known to those skilled in the art and suggested by this disclosure.

Mounted at the opposite end of shaft 58 from control motor 70, drive sprocket 78 receives the same motion inputs as control shaft 58. Drive sprocket 78 is connected by means of drive chain 80 to driven sprocket 86 of phaser 72. Crankshaft 76 powers phaser 72 and ultimately, camshaft 44, by means of a chain or belt 77. In essence, motor 70 provides angular position control for control shaft 58 and for phaser 72, which has an angular input control carrier.

Figure 2:
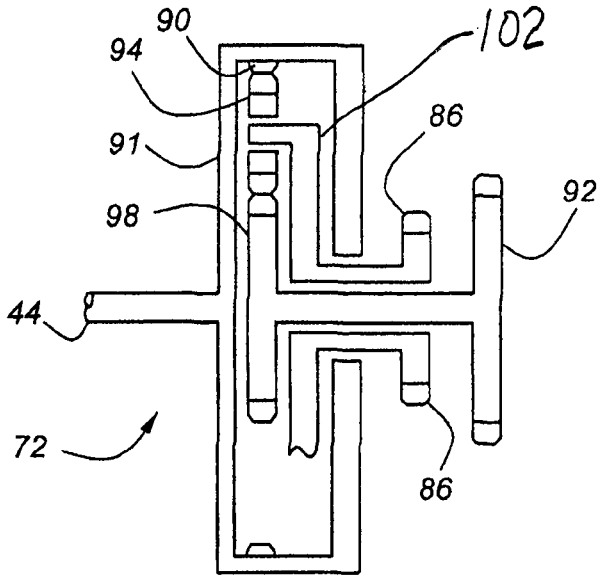
FIG. 2 is a partially schematic representation of a planetary phaser shown in FIG. 1, taken along the line 2-2 of FIG. 1.

FIG. 2 is a partially schematic representation of the construction of phaser 72. Camshaft 44 is shown as being attached to ring gear housing 91, which is driven by planet gears 94. Planet gears 94 are pivotally attached to angular input control carrier 102, which also carries sprocket 86, a driven sprocket. Thus, sprockets 78 and 86, and drive chain 80 form a servo mechanism, in this case, a flexible drive, for positioning carrier 102 according to the input position of the variable lift mechanism. Phaser 72 also includes ring gear 90, which is driven by planet gears 94 and sun gear 98. Driven sprocket 92, which occupies a common shaft with sun gear 98, is connected with crankshaft 76 by means of chain or belt 77. Thus, sprocket 92 drives sun gear 98. In one configuration, the various gear ratios are set so that camshaft 44 will rotate at one-half the rotational speed of crankshaft 76. This will produce the valve timing commonly associated with a four-stroke cycle internal combustion engine.

When engine control unit 74 sets the position of control shaft 58 by means of control motor 70, sprockets 78 and 86 and chain or belt 80 set the position of carrier 102. The rotational position of carrier 102 determines the valve timing, or in another words, the camshaft phasing. Note that carrier 102 is intended to operate in a stationary position; carrier 102 does not rotate with the balance of phaser 72.

Figure 3:
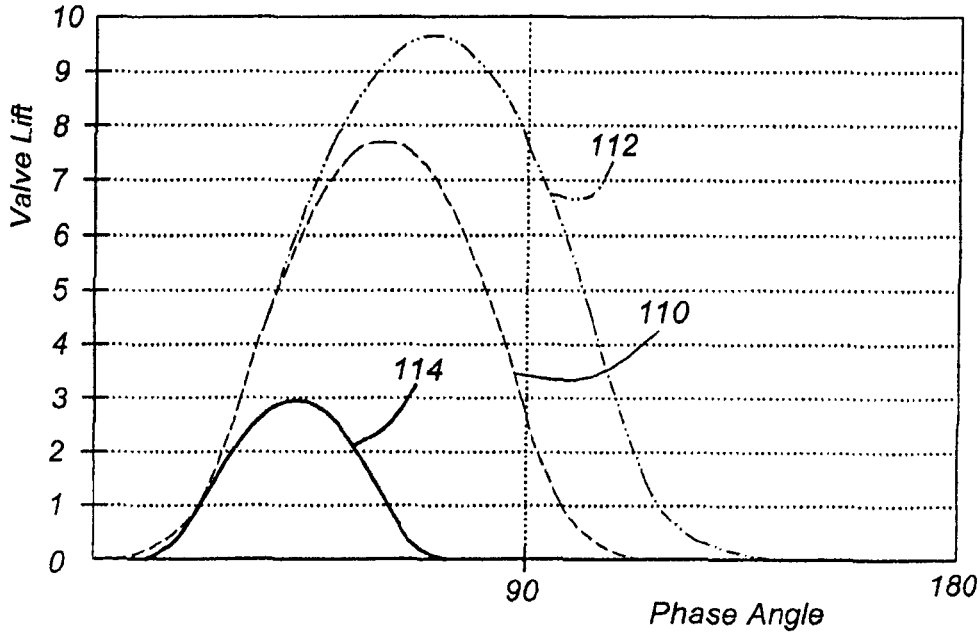
FIG. 3 is shows a family of valve lift and timing curves typical of those achievable by a system according to the present invention.

FIG. 3 illustrates a plot of variable valve lift and camshaft phasing. Because of the phasing relationship produced by phaser 72 in combination with sprockets 78 and 86 and drive chain 82, it is possible to produce the series of curves shown in FIG. 3. Curve 110 it would be useful for operating an engine at full load. Curves 112 and 114 would be more useful at part load; more specifically, curve 114 would be more useful at idle. If the ability to control cam phase did not exist, each of the curves would be centered about a common point instead of being shifted on the timing, or phase angle, axis. It is anticipated that control motor 70 will position angular input control shaft 58 and said angular input control carrier 102 in one of a plurality of predetermined positions, with at least some of the positions corresponding to the various curves of FIG. 3.

Because control motor 70 operates not only the variable lift function of the present system, but also the camshaft timing function the need for a second motor and an attendant support system is obviated. This reduces the cost, weight, complexity, and package volume of the present system, as compared with other systems requiring two actuators.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A poppet valve operating system for an internal combustion engine, comprising:

a camshaft;

a variable valve lift control system driven by said camshaft and having an angular control input;

a camshaft phaser driving said camshaft and having an angular control input; and a controller for providing angular position control for said variable valve lift control system and for said camshaft phaser, wherein said phaser has a planetary drive comprising: a sun gear driven by the engine's crankshaft; a plurality of planet gears driven by said sun gear, with said plurality of planet gears being mounted rotatably upon a carrier having an angular position which is determinative of the camshaft's timing; and a ring gear driven by said planet gears, with said ring gear being rotatably locked to said camshaft.

2. A poppet valve operating system according to claim 1, wherein said controller comprises a motor operatively connected with an angular control shaft incorporated within said variable valve lift control system, with said controller further comprising a servo system extending between said valve lift control system and said angular control input of said camshaft phaser.

3. A poppet valve operating system according to claim 2, wherein said motor comprises a hydraulic motor.

4. A poppet valve operating system according to claim 2, wherein said motor comprises an electric motor.

5. A poppet valve operating system according to claim 2, wherein said servo system comprises a flexible position transmitting system.

6. A poppet valve operating system according to claim 5, wherein said servo system comprises a drive sprocket mounted to said angular control shaft, a driven sprocket mounted to a portion of said camshaft phaser comprising an angular control input, and a chain extending between the drive and driven sprockets.

7. A poppet valve operating system according to claim 2, wherein said servo system comprises a gear train having at least a drive gear attached to said angular control shaft and a driven gear attached to said angular control input of said camshaft phaser.

8. A poppet valve operating system for an internal combustion engine, comprising:

a camshaft;

a variable valve lift control system driven by said camshaft and having an angular control input;

a camshaft phaser attached to said camshaft and having an angular control input comprising the angular positioning of a planet carrier having a plurality of planet gears interposed between a crankshaft driven sun gear and a ring gear locked to said camshaft; and a single-motor controller for providing angular position control for said variable valve lift control system and for said planet carrier.

9. A method for controlling the valve lift and timing of a poppet valve for an internal combustion engine, comprising the steps of:

providing a variable valve lift control system driven by a camshaft and having an angular input control shaft;

providing a planetary camshaft phaser for driving said camshaft and having an angular input control carrier; and providing a single-motor controller for controlling the angular positions of said angular input control shaft and said angular input control carrier.

10. A method according to claim 9, wherein said single-motor controller positions said angular input control shaft and said angular input control carrier in one of a plurality of predetermined positions.

* * * * *